US006371822B1

(12) United States Patent
Oh

(10) Patent No.: US 6,371,822 B1
(45) Date of Patent: Apr. 16, 2002

(54) COMPOSITION OF BARRIER RIB MATERIAL IN DISPLAY PANEL

(75) Inventor: Jin Mok Oh, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/475,263

(22) Filed: Dec. 30, 1999

(30) Foreign Application Priority Data

Dec. 31, 1998 (KR) ..... P98-63396

(51) Int. Cl.[7] ..... H01J 9/24
(52) U.S. Cl. ..... 445/24; 313/582
(58) Field of Search ..... 445/24; 313/584, 313/582

(56) References Cited

U.S. PATENT DOCUMENTS 5,030,397 A * 7/1991 Bandyopadhyay et al. ... 264/63
5,087,399 A * 2/1992 Neil et al. ..... 264/62
5,818,168 A * 10/1998 Ushifusa et al. ..... 313/584

FOREIGN PATENT DOCUMENTS

JP 53122360 A 10/1978

* cited by examiner

*Primary Examiner*—Kenneth J. Ramsey
(74) *Attorney, Agent, or Firm*—Birch, Stewart, Kolasch & Birch, LLP

(57) ABSTRACT

A composition of barrier rib material that is capable of improving a strength of a barrier rib. The composition of barrier rib material includes a barrier rib material paste and a fiber material having a certain tensile strength, thereby increasing the compressed strength and the tensile strength of the barrier rib.

6 Claims, 3 Drawing Sheets

COMPOSITION OF BARRIER RIB MATERIAL IN DISPLAY PANEL

BACKGROUND OF THE INVENTION

1. Field of the Invention

This invention relates to a display panel, and more particularly to a barrier rib composition capable of improving a strength of a barrier rib in the plasma display panel.

2. Description of the Related Art

Generally, a plasma display panel(PDP) radiates a fluorescent body by an ultraviolet with a wavelength of 147 nm generated during a discharge of He+Xe or Ne+Xe gas to thereby display a picture including characters and graphics. Such a PDP is easy to be made into a thin film and large-dimension type. Moreover, the PDP provides a very improved picture quality owing to a recent technical development. The PDP is largely classified into a direct current (DC) driving system and an alternating current (AC) driving system.

The PDP of AC driving system is expected to be highlighted into a future display device because it has advantages in the low voltage drive and a prolonged life in comparison to the PDP of DC driving system. Also, the PDP of alternating current driving system allows an alternating voltage signal to be applied between electrodes having dielectric layer therebetween to generate a discharge every half-period of the signal, thereby displaying a picture. Since such an AC driving system PDP uses a dielectric material, the surface of the dielectric material is charged with wall charge. The AC-type PDP allows a memory effect to be produced by a wall charge accumulated to the dielectric material due to the discharge.

FIG. 1 and FIG. 2 are a perspective view and a sectional view of a conventional AC-type PDP having a discharge cell arranged in a matrix pattern, respectively. In FIG. 2, the AC-type PDP is illustrated in a state of rotating a lower plate at 90° for the sake of an easy understanding. The AC-type PDP includes a front substrate 10 provided with a sustaining electrode pair 12A and 12B, and a rear substrate 18 provided with an address electrode 20. The front substrate 10 and the rear substrate 18 are spaced in parallel with having a barrier rib 24 therebetween. A mixture gas such as Ne–Xe or He–Xe, etc. is injected into a discharge space defined by the front substrate 10 and the rear substrate 18 and the barrier rib 24. Any one of the sustaining electrode pair is used as a scanning/sustaining electrode 12A that responds to a scanning pulse applied in an address interval to cause an opposite discharge along with the address electrode 20 while responding to a sustaining pulse applied in a sustaining interval to cause a surface discharge with the adjacent sustaining electrode 12B. The sustaining electrode 12B adjacent to the scanning/sustaining electrode 12A is used as a common sustaining electrode to which a sustaining pulse is applied commonly. A distance a between the sustaining electrodes 12A and 12B making a pair is set to be approximately 100 $\mu$m. On the front substrate 1 provided with the sustaining electrodes 12A and 12B, a dielectric layer 14 and a protective film 16 are disposed. The dielectric layer 14 is responsible for limiting a plasma discharge current as well as accumulating a wall charge during the discharge. The protective film 16 prevents a damage of the dielectric layer 14 caused by a sputtering generated during the plasma discharge and improves an emission efficiency of secondary electrons. This protective film 16 is usually made from MgO. Barrier ribs 24 for dividing the discharge space is extended perpendicularly at the rear substrate 18, and the address electrode 20 is formed between the barrier ribs 24. On the rear substrate 18 provided with the barrier ribs 24 and the address electrode 20, a fluorescent layer 26 excited by a vacuum ultraviolet Ray to generate a visible light is provided.

As shown in FIG. 3, such a discharge cell is arranged in a matrix pattern. At each of the discharge cells (11), scanning/sustaining electrode lines Y1 to Ym, common sustaining electrode lines Z1 to Zm and address electrode lines X1 to Xn are crossed with respect to each other. The scanning/sustaining electrode lines Y1 to Ym and the common sustaining electrode lines Z1 to Zm consist of the sustaining electrodes 12A and 12B making a pair. The address electrode lines X1 to Xn consist of the address electrode 20.

In the PDP having the above-mentioned configuration, the barrier ribs 24 support the front substrate 10 and the rear substrate 18. Also, the barrier ribs 24 prevent an ultraviolet ray generated by the discharge from being leaked into the adjacent discharge cell and reflect a rear light emitted from the fluorescent layer 26, thereby increasing the brightness of the PDP. The top portion of the barrier rib 24 has a black color so as to improve the contrast of a screen.

A process of fabricating the barrier ribs 24 will be described below. First, ceramic powder is usually mixed with an organic binder and an organic solvent, etc to be made into a paste state. Subsequently, the mixed paste is used to form a pattern on the rear substrate 18 by the screen printing technique and then is dried and tempered, thereby forming the barrier ribs. Otherwise, the barrier ribs 24 may be formed by entirely printing the paste on the rear substrate 18 and drying it and thereafter patterning the paste using the sand blast technique and tempering it.

However, the ceramic tempered material has a problem in that, since it is an inorganic material, a compressed strength is strong while a tensile strength is weak in accordance with an intrinsic characteristic of cermic. Accordingly, the conventional barrier ribs 24 made from the ceramic tempered material generate a crack by a tensile force induced by vertical compressive force exerting on the barrier ribs 24 during a process of attaching the front substrate 10 to the rear substrate 18. Also, the conventional barrier ribs 24 made from the ceramic tempered material may experience its partial damage due to an exterior impact during a fabrication process and a transportation of the product.

SUMMARY OF THE INVENTION

Accordingly, it is an object of the present invention to provide a composition of barrier rib material that is capable of improving a strength of a barrier rib in a plasma display panel.

In order to achieve these and other objects of the invention, a composition of barrier rib material for a plasma display panel according to one aspect of the present invention includes a barrier rib material paste; and a fiber material with a certain tensile strength.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

A composition of barrier rib material according to an embodiment of the present invention includes a conventional barrier rib material paste and a fiber material with an intrinsic tensile strength. A carbon fiber, such as an optical fiber or a whisker, is used for the fiber material. The barrier rib material has a property of complex material such as a concrete when such a fiber material is used with being mixed with the barrier rib material paste, thereby increasing an compressed strength and a tensile strength of the barrier rib.

Figure 1:
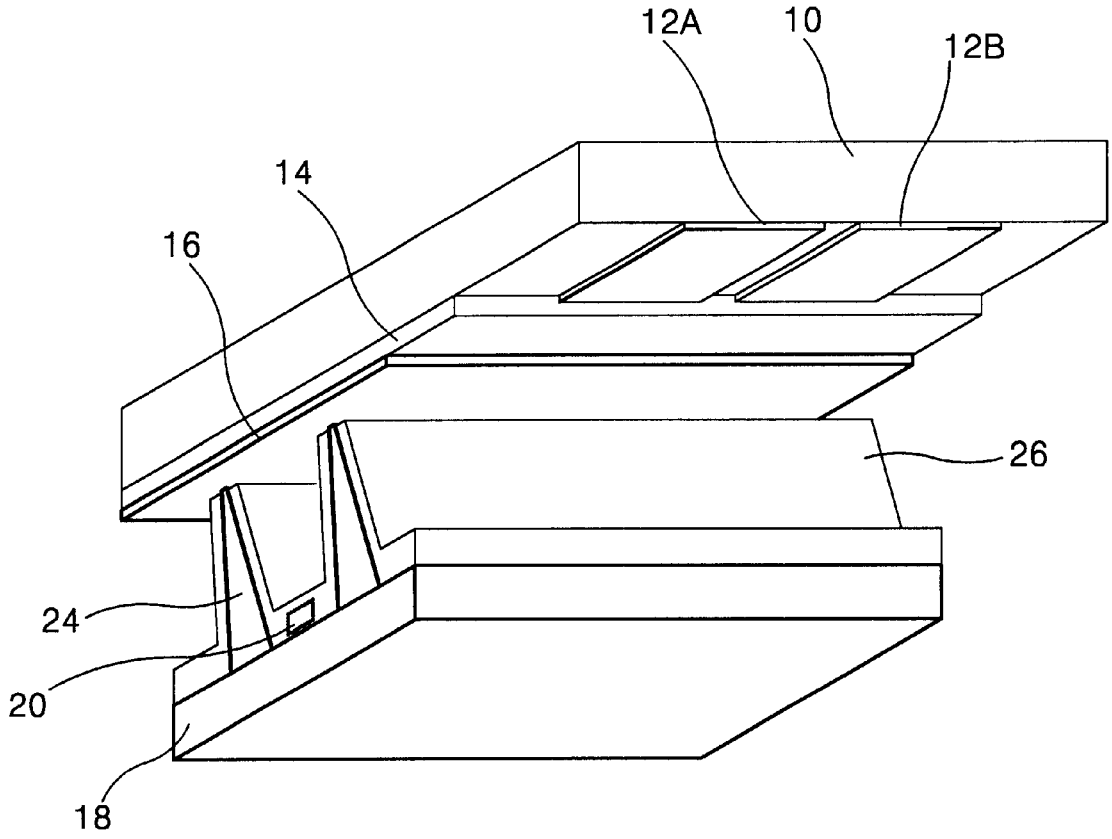
FIG. 1 RELATED ART
FIG. 1 is a perspective view showing the structure of a discharge cell in a conventional three-electrode, AC-type plasma display panel.
Figure 2:
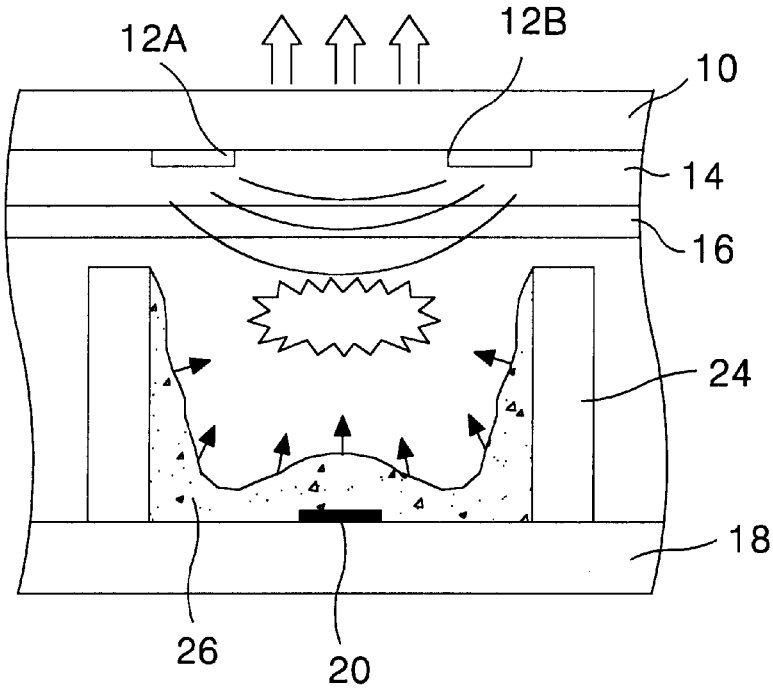
FIG. 2 RELATED ART
FIG. 2 is a sectional view showing the structure of a discharge pixel cell of FIG. 1.
Figure 4:
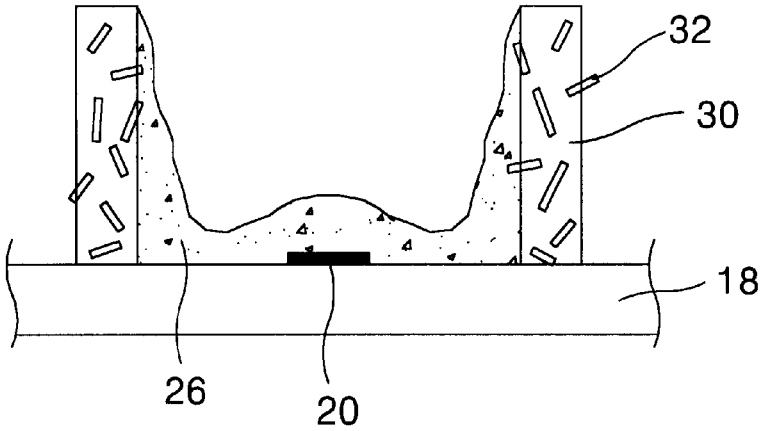
FIG. 4 is a sectional view of a rear substrate of the plasma display panel to which a composition of barrier rib material according to an embodiment of the present invention is applied.
Figure 3:
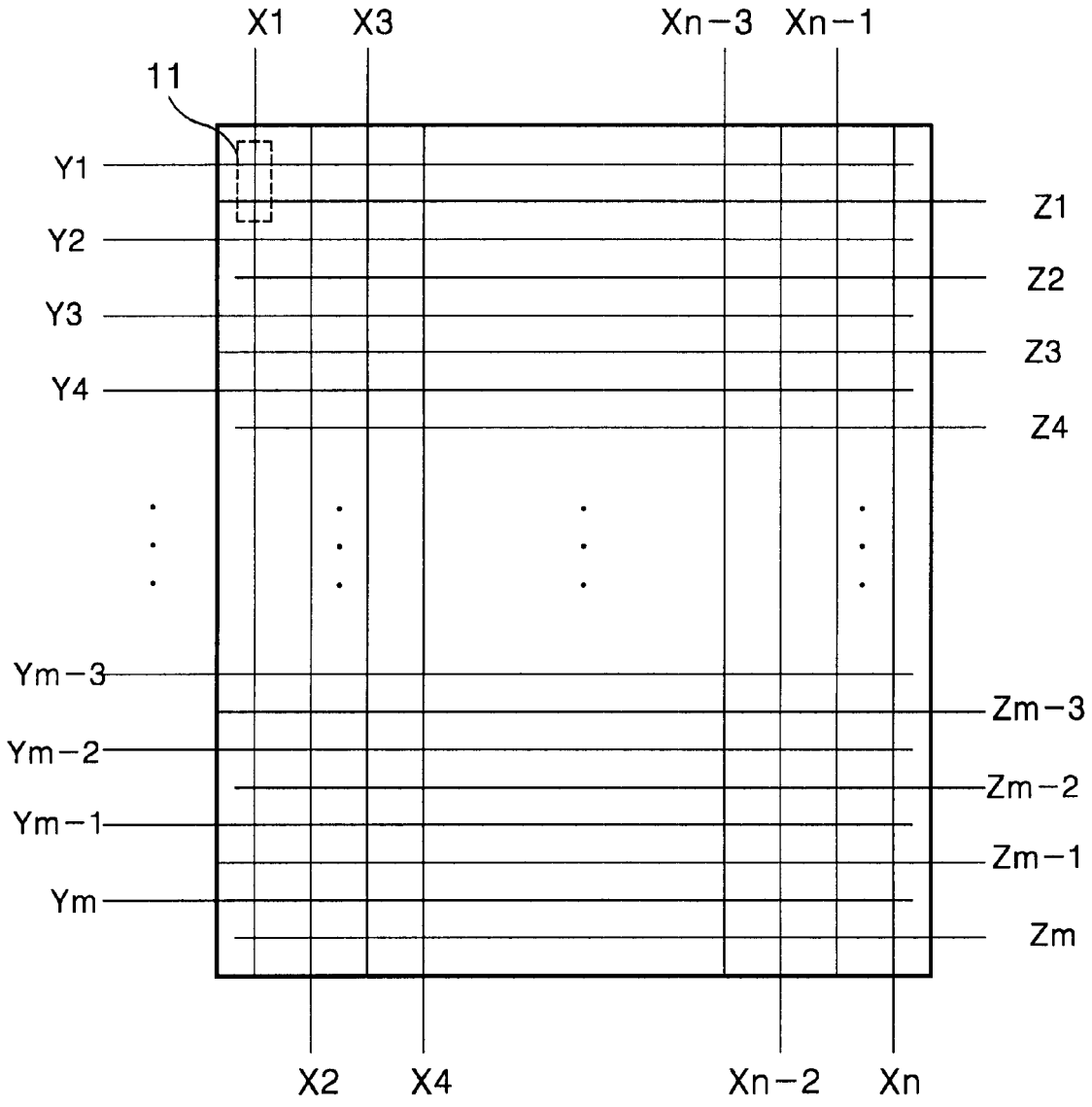
FIG.3 RELATED ART
FIG. 3 illustrates an electrode arrangement of a plasma display panel including the discharge cell of FIG. 1.

Referring to FIG. 4, there is shown a rear substrate part of a PDP having a barrier rib 30 to which the composition of barrier rib is applied. The rear substrate part includes an address electrode 20 a barrier rib 30 provided on a rear substrate 18, and a fluorescent layer 26 coated on the barrier rib 30 and the rear substrate 18. The barrier rib 30 includes a fiber material 32, which is a component able to intensify a tensile strength, so that it is increased in the compressive strength and the tensile strength.

A process of fabricating such a barrier rib 24 will be described below. First, the fiber material 32 is mixed with the barrier rib material paste which is a mixture of conventional ceramic powder, an organic binder and an organic solvent, etc. In this case, 1 to 10 weight % fiber material 32 is mixed with 90 to 99 weight % barrier rib material paste. Preferably, 5 weight % fiber material is mixed. Subsequently, the barrier rib material paste is printed into a certain thickness on the rear substrate 18 using the blade method and dried, and thereafter is patterned using the sand blast method and tempered, thereby forming the barrier rib 30. Otherwise, the barrier rib 30 may be formed by pattern-printing the barrier rib material paste using the screen printing method and then drying and tempering the same. In this case, since the organic binder and the organic solvent, etc. are removed in the temperament process, the barrier rib 30 is made from a ceramic tempered material including the fiber material 32 which is a component able to intensify a tensile strength. Since a temperament temperature of the barrier rib material paste is about 550 to 600° C. while a melting point of the fiber material 32 is about more than 1000° C., a tensile strength of the fiber material 32 is not lost in the temperament process. Accordingly, the fiber material 32 compensates for a deterioration in an tensile strength caused by the temperament generated during a fabrication of the barrier rib 30, to thereby increase the total strength of the barrier rib 30. The fiber material 32 protruded into the exterior of the barrier rib 30 also plays a role to improve a binding force to the fluorescent layer 26 upon coating of the fluorescent layer 26.

As described above, the composition of barrier rib material according to the present invention includes a fiber material, the compressive strength and the tensile strength in the barrier rib made from the composition are increased. Accordingly, the composition of barrier rib material according to the present invention can prevent a generation of a crack in the barrier rib caused by a tensile force exerting on the barrier rib during a process of attaching the front substrate to the rear substrate. The composition of barrier rib material according to the present invention can prevent a part of the barrier rib from being damaged due to an exterior impact that may be caused during the fabrication process and the transportation of the product. Moreover, the composition of barrier rib material according to the present invention can reduce a rate of poor quality in the PDP due to a damage of barrier rib.

Furthermore, the composition of barrier rib material according to the present invention is applicable to a spacer in a flat panel display device such as an field emission display (FED) besides the above-mentioned PDP.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. Barrier rib intermediates for a display panel comprising a mixed composition of barrier rib material, said mixed composition including:

a barrier rib material paste; and a fiber material with a certain tensile strength, wherein the fiber material is selected from any of an optical fiber and a carbon fiber, and wherein said mixed composition is in the form of barrier ribs for a display panel.

2. The barrier rib intermediates of claim 1, wherein the composition consists essentially of the barrier rib material paste of 90–99 weight % and the fiber material of 1–10 weight %.

3. A display panel, comprising:

a substrate;

a plurality of barrier ribs on the substrate containing fibers, some fibers protruding from the barrier ribs; and a fluorescent material disposed among the barrier ribs and in contact with a number of the fibers protruding from the barrier ribs.

4. The display panel according to claim 3, wherein the fibers are selected from any of optical fibers and carbon fibers.

5. The display panel according to claim 3, wherein the fibers constitute from 1 to 10 percent by weight of the barrier ribs.

6. The display panel according to claim 3, wherein the fibers both increase a tensile strength of the barrier ribs and increase a binding force to the fluorescent material.

* * * * *